US008952325B2

(12) United States Patent
Giles et al.

(10) Patent No.: US 8,952,325 B2
(45) Date of Patent: Feb. 10, 2015

(54) CO-AXIAL TIME-OF-FLIGHT MASS SPECTROMETER

(75) Inventors: Roger Giles, Holmfirth (GB); Michael Sudakov, St. Petersburg (RU); Hermann Wollnik, Santa Fe, NM (US)

(73) Assignee: Shimadzu Corporation, Kyoto (JP)

( * ) Notice: Subject to any disclaimer, the term of this patent is extended or adjusted under 35 U.S.C. 154(b) by 1286 days.

(21) Appl. No.: 12/518,240

(22) PCT Filed: Dec. 7, 2007

(86) PCT No.: PCT/GB2007/004683

§ 371 (c)(1),
(2), (4) Date: Dec. 2, 2009

(87) PCT Pub. No.: WO2008/071921

PCT Pub. Date: Jun. 19, 2008

(65) Prior Publication Data

US 2010/0072363 A1 Mar. 25, 2010

(30) Foreign Application Priority Data

Dec. 11, 2006 (GB) ..... 0624677.1

(51) Int. Cl.
*H01J 49/00* (2006.01)
*H01J 49/40* (2006.01)

(52) U.S. Cl.
CPC ..... *H01J 49/406* (2013.01)
USPC ..... 250/287; 250/281

(58) Field of Classification Search
None
See application file for complete search history.

(56) References Cited

U.S. PATENT DOCUMENTS 3,558,879 A * 1/1971 Larson et al. ..... 250/396 R
3,585,383 A * 6/1971 Castaing et al. ..... 850/1
4,625,112 A 11/1986 Yoshida
4,694,170 A * 9/1987 Slodzian et al. ..... 850/9
4,704,532 A * 11/1987 Hua ..... 250/292
5,160,840 A * 11/1992 Vestal ..... 250/287
5,180,914 A * 1/1993 Davis et al. ..... 250/287

(Continued)

FOREIGN PATENT DOCUMENTS

GB 2-080-021 1/1982
GB 2080021 1/1982

(Continued)

OTHER PUBLICATIONS

Wollnik, et al., ("An Energy-isochronous Multi-pass TOF MS Consisting of Two Coaxial Electrostatic Mirrors," International Journal of Mass Spectrometry 227 (2003) pp. 217-222).*

(Continued)

*Primary Examiner* — Andrew Smyth
(74) *Attorney, Agent, or Firm* — Stephen J. Weyer; Stites & Harbison PLLC

(57) ABSTRACT

A co-axial time-of-flight mass spectrometer having a longitudinal axis and first and second ion mirrors at opposite ends of the longitudinal axis. Ions enter the spectrometer along an input trajectory offset from the longitudinal axis and after one or more passes between the mirrors ions leave along an output trajectory offset from the longitudinal axis for detection by an ion detector. The input and output trajectories are offset from the longitudinal axis by an angle no greater than formula (I): where $D_{min}$ is the or the minimum transverse dimension of the ion mirror and L is the distance between the entrances of the ion mirrors.

27 Claims, 9 Drawing Sheets

(56) References Cited

U.S. PATENT DOCUMENTS

| | | | | | |
|---|---|---|---|---|---|
| 5,189,304 | A * | 2/1993 | De Chambost et al. | ..... | 250/296 |
| 5,202,563 | A * | 4/1993 | Cotter et al. | ..... | 250/287 |
| 5,464,985 | A * | 11/1995 | Cornish et al. | ..... | 250/396 R |
| 5,654,544 | A * | 8/1997 | Dresch | ..... | 250/287 |
| 5,994,695 | A * | 11/1999 | Young | ..... | 250/287 |
| 6,013,913 | A * | 1/2000 | Hanson | ..... | 250/287 |
| 6,107,625 | A * | 8/2000 | Park | ..... | 250/287 |
| 6,150,657 | A * | 11/2000 | Kimoto et al. | ..... | 250/305 |
| 6,384,410 | B1 * | 5/2002 | Kawato | ..... | 250/287 |
| 6,469,295 | B1 * | 10/2002 | Park | ..... | 250/282 |
| 6,570,152 | B1 * | 5/2003 | Hoyes | ..... | 250/287 |
| 6,781,121 | B1 * | 8/2004 | Davis et al. | ..... | 250/287 |
| 6,888,130 | B1 * | 5/2005 | Gonin | ..... | 250/287 |
| 7,326,925 | B2 * | 2/2008 | Verentchikov et al. | ..... | 250/287 |
| 7,385,187 | B2 * | 6/2008 | Verentchikov et al. | ..... | 250/287 |
| 7,772,547 | B2 * | 8/2010 | Verentchikov | ..... | 250/287 |
| 2004/0159782 | A1 * | 8/2004 | Park | ..... | 250/282 |
| 2005/0242279 | A1 * | 11/2005 | Verentchikov | ..... | 250/287 |
| 2006/0163469 | A1 * | 7/2006 | Vestal | ..... | 250/287 |
| 2006/0219890 | A1 * | 10/2006 | Yamaguchi | ..... | 250/287 |
| 2008/0087841 | A1 * | 4/2008 | Verbeck et al. | ..... | 250/396 R |

FOREIGN PATENT DOCUMENTS

| | | | | | |
|---|---|---|---|---|---|
| GB | 2080021 | A * | 1/1982 | ..... | H01J 49/40 |
| GB | 2-361-806 | | 10/2001 | | |
| GB | 2-403-063 | | 12/2004 | | |
| GB | 2403063 | A * | 12/2004 | ..... | H01J 49/40 |
| JP | 03004433 | A * | 1/1991 | ..... | H01J 49/40 |
| WO | WO-92/21140 | | 11/1992 | | |
| WO | WO-2006/102430 | | 9/2006 | | |
| WO | WO 2006102430 | A2 * | 9/2006 | | |
| WO | WO 2006102430 | A3 * | 12/2007 | | |

OTHER PUBLICATIONS

UK Intellectual Property Office, Search Report, May 11, 2007, For Application No. GB0624677.1.

European Patent Office, International Search Report, Oct. 15, 2008, For International Application No. PCT/GB2007/004683.

Mamyrin, B.A., et al., "The mass-reflectron, a new nonmagnetic time-of-flight mass spectrometer with high resolution", Jul. 1973, pp. 45-48, Sov. Phys. JETP, vol. 37, No. 1.

Michael, Steven M., et al., "An ion trap storage/time-of-flight mass spectrometer", Oct. 1992, pp. 4277-4284, Rev. Sci. Instrum. 63 (10).

Toyoda, Michisato, et al., "Multi-turn time-of-flight mass spectrometers with electrostatic sectors", Jul. 19, 2003, pp. 1125-1142, J. Mass. Spectrom. 2003, vol. 38.

Satoh, Takaya, et al., The Design and Characteristic Features of a New Time-of-Flight Mass Spectrometer with a Spiral Ion Trajectory, Apr. 27, 2005, pp. 1969-1975, J. Am. Soc.Mass. Spec., Dec. 2005, vol. 16, No. 12.

Wollnik, "Sector Field Lenses", 1987, Chapter 4, pp. 89-137, Optics of Charged Particles, Academic Press.

Office Action for Japanese Application No. 2009-540839, Nov. 27, 2012, Japanese Patent Office.

* cited by examiner

CO-AXIAL TIME-OF-FLIGHT MASS SPECTROMETER

This invention relates to a co-axial time-of-flight (ToF) mass spectrometer.

ToF mass spectrometers, including quadrupole mass filter-ToF mass spectrometers and quadrupole ion trap ToF mass spectrometers are now commonly employed in the field of mass spectrometry. Commercially available ToF instruments offer resolving power of up to ~20 k and a maximum mass accuracy of 3 to 5 ppm. By comparison, FTICR (Fourier Transform Ion Cyclotron Resonance) instruments can achieve a much higher resolving power of at least 100 k. The primary advantage of such high resolving power is improved accuracy of mass measurement. This is necessary to confidently identify the analysed compounds.

However, despite their very high resolving power, FTICR instruments have a number of disadvantages in comparison to ToF instruments. Firstly, the number of spectra that can be recorded per second is low, and secondly at least 100 ions are necessary to register a spectral peak of reasonable intensity. These two disadvantages mean that the limit of detection is compromised. A third disadvantage of FTICR instruments is that a superconducting magnet is required. This means that the instrument is bulky, and has associated high purchase costs and high running costs. Therefore, there is a strong incentive to improve the resolving power offered by ToF mass spectrometers.

In a mass spectrometer with mass resolution of 10-20 k the accuracy of mass measurement that can be achieved depends strongly upon the intensity of the peak to be identified, as well as on the intensity of the calibration peaks.

Theoretically, if the instrument resolving power is 15 k then a peak must be composed of at least 50 ions to have a mass accuracy of 5 ppm. To increase the mass accuracy to 1 ppm at least 1000 ions are required. If the instrument resolving power is increased to 100 k, then the number of ions required for mass accuracies of 5 ppm and 1 ppm decrease to 1 and 20 respectively.

In reality however, a mass spectrum will contain peaks of high and low intensity. High resolving power is need to achieve good mass accuracy in a large dynamic range.

High resolving power is also required to avoid isobaric interference. This type of interference occurs when mixtures of analytes are analysed simultaneously. In this situation, different ion species may have very close m/z values and their peaks in the spectrum may overlap. If the overlapping peaks are not resolved this may lead to errors in the measured mass of the analyte (due to the presence of unwanted contaminants). This effect is particularly evident when analysing ions with a mass greater than 500 Da, as above this threshold there are many different compositions that are within a few ppm of the same m/z value.

Matrix effects arising from background chemical noise can also lead to isobaric interference. This typically occurs when the concentration of analyte ions is low and the analyte ions are distributed over a wide mass range. Isobaric interference can be reduced by improving the resolving power of the instrument.

It is desirable to achieve a high dynamic range within each acquired spectrum, so that the spectrum provides high fidelity data (good statistics and high signal-to-noise ratio), making it unnecessary to accumulate a large number of equivalent spectra. Avoiding the need for such accumulation is equivalent to increasing the effective repetition rate, and again enhances productivity.

To achieve the highest possible mass accuracy it is necessary for the spectra to include at least one internal calibration peak. A large mass range has the advantage that it enables unknown peaks to lie within a corresponding wider mass range, without the need for a custom calibrant for each analyte.

A second advantage of a wide mass range capability is in the MS/MS analysis of peptides; peptide ions fragment such that only the bonds between adjacent amino acids in the peptide chain are broken. A series of peaks are generated which enable the amino acid sequence of the peptide to be identified. These peaks have a wide distribution of m/z values, and as the probability of a unique identification of the protein is dependent upon the number of detected peaks it is advantageous to have a wide mass range available.

The resolving power, $R_m$ of a ToF mass spectrometer is given by:

$$R_m = 2 \cdot \frac{T_f}{\Delta T} \tag{1}$$

where $T_f$ represents the ions flight time and is given by:

$$T_f = C \cdot L\left(\frac{2K \cdot \gamma}{M}\right)^{-1/2}, \tag{2}$$

$\Delta T$ represents the FWHM peak width that is associated with a single m/z species, K is the initial ion energy (in electron volts), M is the ion mass (in Daltons), $\gamma = 9.979997 \times 10^7$ [Coulombs/Kg], L is the flight path length and C is a dimensionless constant relating to a particular ToF apparatus.

Any ToF mass spectrometer that provides acceptable resolving power must use energy focusing, so that the flight time of the ions is independent of their energy. The concept of the ion mirror for energy focusing was first described by in *Sov. Phys JETP* 1973 *P.*3745 (Mamyrin) and was adapted in a mass spectrometer with Electrospray Ionization (ESI) by Dodonov, in a system having orthogonal extraction (or ToF) and two stage ion mirror. *Proceedings of* 12$^{th}$ *International Mass Spectrometry Conference* 26-30 Aug. 1991 p. 153.

Commercial or -ToF (orthogonal-ToF) mass spectrometers presently available are essentially of the same format, and can achieve a resolving power of ~10 to 20 k. More recently the IT-ToF (Ion-Trap-TOF) mass spectrometer was developed. This instrument can provide $MS^n$ analysis in combination with ToF analysis (Michael et al, *Rev. Sci. Instrument* 63 p. 4277), the IT-ToF employs a single ion mirror and has a maximum resolving power of ~15 k. The two stage Mamyrin ion mirror can correct the time of flight with respect to the energy deviation to second order. This correction is limited to a relatively small energy range of a few percent, thus the ion source must provide ions that have a narrow energy spread, typically a few percent of the beam energy.

An ion mirror that has a parabolic potential distribution can provide time focusing of ions from an ion source having a much wider energy spread, provided that the ion source and the ion detector are located close to the entrance plane of the mirror. U.S. Pat. No. 4,625,112 describes an ion mirror with combined linear and parabolic potentials. This type of mirror will accept a wide energy spread, and is generally more useful in a practical instrument than the parabolic mirror, as the ion source and detector can be located in a range of positions.

In all these types of ion mirrors, there are a number of contributions to $\Delta T$. These include the response of the detector ($\Delta T_{detector}$), the 'turn around time' of ions in the ion source ($\Delta T_{turn_around}$), the timing pulse jitter of the electronics ($\Delta T_{jitter}$), and the power supply stability. Additionally, there are contributions from chromatic aberrations ($\Delta T_{chrono_ab}$) and spherical aberrations ($\Delta T_{sph_ab}$) of the ToF mass spectrometer. ΔT can be expressed in terms of these individual contributions as follows:

$$\Delta T = \sqrt{\Delta T^2_{detector} + \Delta T^2_{turn_around} + \Delta T^2_{t_jitter} + \Delta T^2_{chro_ab} + \Delta T^2_{sph_ab}} \quad (3)$$

To achieve the highest resolving power it is necessary to minimise the individual contributions in equation (3) as much as possible. However, there is a limit to which these can be minimised for known instruments and most commercial instruments already operate close to this limit.

One possibility for improving the mass resolving power is to lengthen the flight time, $T_f$ of ions in the ToF mass spectrometer. Equation 2 suggests that this can be done by reducing the energy, K, of the ions in the ToF spectrometer. However, this may be counterproductive, as $\Delta T_{sph_ab}$ will increase as K is reduced, as will $\Delta T_{turn_around}$, which increases in proportion to 1/K. There is an optimum value of K, usually in the range of 5 to 20 kV, at which to operate a particular ToF mass spectrometer and so the energy K cannot be reduced to increase the resolution.

Another option then, is to increase the length of the flight path L. For practical reasons, the overall dimensions of a commercial ToF instrument must be <2 m. In an attempt to address this problem and realise an instrument with reasonable physical size, the concept of the multi-turn time of flight (M-ToF) spectrometer was proposed by Wollnik in GB 2080021. In this spectrometer the ion flight path is effectively 'folded up', such that ions are reflected repeatedly back and forwards along the same flight path. To work effectively, such a spectrometer must have isochronous properties, that is, ions are repeatedly brought to a temporal focus after a certain number of passes. The spectrometer is tuned such that ions enter the spectrometer via a first isochronous point and are brought to a final isochronous focus point at the point of their impact with a detector. However, it is difficult to maintain such isochronicity in a M-ToF spectrometer of the form described in GB 2080021; and high resolution can only be achieved when ions undergo many turns (or passes), N (i.e. the length of the flight path is long). The m/z range that can be recorded in a ToF mass spectrometer diminishes as the number of turns, N, is increased. This is a drawback of the prior art M-ToF spectrometers. The ratio of maximum to minimum m/z that can be obtained is defined in terms of the number of turns, N, by the following equation:

$$m_{max} = m_{min}\left(\frac{N}{N-1}\right)^2 \quad (4)$$

and so the higher the required mass resolving power, the lower the available m/z range. Another implementation of a multi-turn ToF spectrometer is described by Toyoda in *J. Mass Spectrom* 2003 38 p. 1125. In this M-ToF spectrometer ions describe a figure of eight trajectory. The resolving power increases and the m/z range diminishes with the number of turns. In this instrument, after 25 turns the resolving power reaches 23 k and after 501 turns it reaches 350 k. Despite this very high resolving power, this instrument still suffers from a diminishingly small m/z range as the resolution increases and so is again not very useful for most applications. A further drawback is that the very long flight path of the multi-turn ToF mass spectrometer described above requires the vacuum pressure to be much lower than in conventional ToF spectrometers. This reduced pressure is necessary to reduce the probability of scattering from residual gas atoms, which will lead to loss of intensity and broadening of the spectral peaks. In Toyoda's instrument the intensity drops to <10% after N=500.

To address the issue of the limited m/z range in the M-ToF spectrometer, it is possible to replicate the flight path, by introducing more ion mirrors, arranged to reflect ions sequentially in turn, so as to achieve some folding up of the flight path from one to two dimensions. In this approach, ions will describe a single path through the spectrometer, and so the flight path, and therefore the resolving power may be increased without compromising the m/z range.

A first example of an extended 'single pass' ToF spectrometer was described by Hoyes et al in U.S. Pat. No. 6,570,152. In this instrument, a large ion mirror and a small ion mirror are used, and the ions describe W-shaped trajectories as they pass between the mirrors. This increases the flight path by a factor of 2.5 compared to spectrometers with a conventional V-shaped trajectory.

Various other single pass ToF instruments with extended flight path have also previously been described. For example, WO 2005/001878 describes two planar ion mirrors with an array of twelve enziel lenses placed in an intermediate plane. These enziel lenses refocus the ion beam after each reflection, thus preventing angular divergence of the beam as it travels through the instrument. This refocusing is essential to ensure that the spherical aberrations are maintained within reasonable limits. This spectrometer allows for 2×12 reflections at a demonstrated resolving power of 50 k, and at a full m/z range. A disadvantage of this spectrometer is the low acceptance, i.e., it can only accept an ion cloud of a small phase space emittance. This limits the instrument sensitivity. Furthermore, the complex geometry of the optical elements, together with the precise alignment requirements make this apparatus relatively difficult and expensive to realise in practice.

Recently, an alternative extended single pass ToF spectrometer was proposed by Satoh et al, J. Am. Soc. Mass Spec. December 2005, Volume 16, No. 12, Pages 1969-1975, based on the above described M-ToF spectrometer of Toyoda. The proposed spectrometer has toroidal sectors extending along one axis. Ions pass through the spectrometer in a 'cork screw' type trajectory, by introducing the ions at an angle such that they travel along the flight path with 50 mm axial displacement each turn. Ions undergo a total of 15 orbits, giving a flight path of 20 m and a full m/z range resolving power of 35 k. The phase space acceptance area of this instrument is relatively small, so it will also suffer from limited sensitivity. The manufacture and alignment of the ion optical elements to high tolerances is also relatively difficult and expensive.

A common feature of known M-ToF spectrometers is that the electrode voltages must be switched in order to allow ions into and out of the instrument. This switching must be done at very high speeds and the new voltage level established to a high stability in a very short time. Technically, this is difficult to achieve, and inevitably, the electrode voltage stability is compromised. The reduced voltage stability ultimately reduces the m/z range, which in turn adversely influences the accuracy of m/z measurement.

For example, in GB 2080021, the first isochronous focus point is within the ion mirror, and so to achieve the best resolution possible it is necessary to introduce ions into the flight path along an entrance trajectory through the ion mirror, co-axial with the flight path (i.e. along the longitudinal axis of the mirror). This suffers from the problems associated with switching as discussed immediately above, and generally the minimised values of the spherical and chromatic aberrations contributing to ΔT are larger than is desired.

According to the invention there is provided a co-axial time-of-flight mass spectrometer comprising: first and second electrostatic ion mirrors arranged in opposed relationship on a common longitudinal axis; an ion source for supplying ions to a said ion mirror along an input trajectory, said ions being supplied via a first isochronous point and ion detection means for receiving ions reflected at a said ion mirror along an output trajectory, said ions being received at said detection means at or via a second isochronous point, after said received ions have performed at least one pass between said ion mirrors, wherein said input trajectory and said, output trajectory are offset from said longitudinal axis by an angle less than or equal to $$^{-1}\left[\frac{D_{min}}{2L}\right],$$

where $D_{min}$ is the, or the minimum, outside transverse dimension of said ion mirrors, and L is the distance between the entrances of said ion mirrors.

Embodiments of the invention are now described, by way of example only, with reference to the accompanying drawings in which;

FIG. 2(*b*) shows the trajectory of ions on a 2-turn pass through the ToF mass spectrometer;

FIG. 2(*c*) shows the trajectory of ions on a 3-turn pass through the ToF mass spectrometer;

FIG. 4(*b*) is a cross-sectional view of a second embodiment of the tilting electrode of the ion mirror;

FIG. 4(*c*) is a cross-sectional view of a third embodiment of the tilting electrode of the ion mirror;

FIG. 5(*b*) is a representation of the combined reflecting and tilting field created by a tilting electrode;

FIG. 7(*b*) is a plot of resolving power vs number of turns, N, for a second parameter set;

Figure 1:
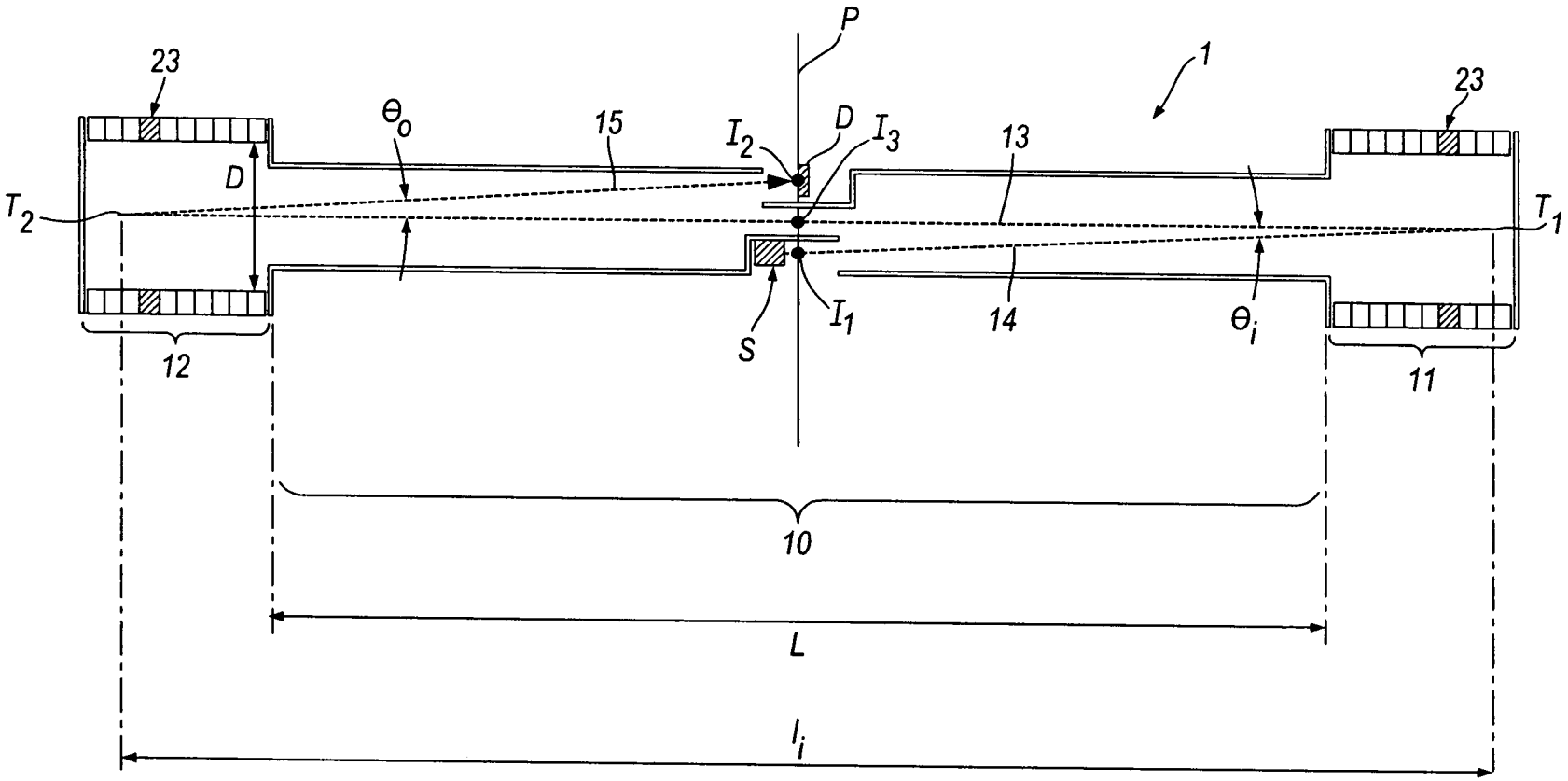
FIG. 1 shows a cross-sectional view of a ToF mass spectrometer of a preferred embodiment of the invention.

FIG. 1 of the drawings shows a longitudinal cross-sectional view of a ToF mass spectrometer 1. The spectrometer includes a central section 10 and first and second electrostatic ion mirrors 11, 12 arranged in opposed relationship on a common longitudinal axis 13 at opposite ends of the central section 10. Central section 10 may be a flight tube or any other suitable structure defining a flight path between the ion mirrors e.g. a set of parallel supporting rods.

In this embodiment, each ion mirror 11, 12 is circular in cross-section and is constructed from a set of concentric annular ring electrodes to which respective DC voltage is applied to generate an electrostatic reflecting field within the ion mirror.

Alternatively, each ion mirror may have an oval cross-section, and in a yet further embodiment each ion mirror may comprise a pair of parallel plate electrodes.

The spectrometer also includes an ion source S and an ion detector D. The ion source S may be a 2D or a 3D ion trap or any other suitable ion source such as a MALDI ion source or an ESI ion source. The ion detector D is typically a micro-channel plate detector, although other forms of ion detector could alternatively be used.

In operation, ion source S supplies ions to the first ion mirror 11 via a first isochronous point $I_1$. The ions are received in the first ion mirror 11 along an input trajectory 14 which is offset from the longitudinal axis 13 by an angle $\theta_i$. The electrostatic reflecting field generated by the first ion mirror 11 reflects the received ions at a turning point $T_1$ inside the first ion mirror 11, the received ions being reflected towards the second ion mirror 12 along the longitudinal axis 13. The electrostatic reflecting field generated by the second ion mirror 12 reflects the received ions at a turning point $T_2$ inside the ion mirror, the received ions being reflected along an output trajectory 15 which is offset from the longitudinal axis 13 by an angle $\theta_o$, and terminates at a second isochronous point $I_2$, coincident with a detection surface of detector D.

In the above-described embodiment, ions undergo a single reflection at each ion mirror 11, 12; that is, the ions execute a single pass between the ion mirrors before they are directed to the ion detector D along the output trajectory 15.

In alternative embodiments of the invention, ions undergo multiple reflections at each ion mirror 11, 12; that is, the ions execute multiple passes between the ion mirrors before being directed to the ion detector D along the output trajectory 15. To that end, each ion mirror 11, 12 is arranged selectively to control the angle of reflection. More specifically, each ion mirror 11, 12 can operate selectively in one of two different modes. In a first 'deflecting' mode, ions enter ion mirror 11 along the input trajectory 14 and are reflected through angle $\theta_i$ onto the longitudinal axis 13. Similarly, ions moving on the longitudinal axis 13 are reflected by the second ion mirror 12, through angle $\theta_o$, onto the output trajectory 15. By contrast, in a second 'non-deflecting' mode, ions moving on the longitudinal axis 13 are reflected back along the longitudinal axis.

By appropriately selecting the operating mode of each ion mirror, ions entering the first ion mirror 11 along the input trajectory 14 are reflected onto the longitudinal axis 13 and may undergo multiple passes between the ion mirrors before being reflected onto the output trajectory 15 by the second ion mirror 12. This can be accomplished by switching the first ion mirror 11 from the 'deflecting' mode to the 'non-deflecting' mode following the initial reflection of ions at the first ion mirror 11, and by switching the second ion mirror 12 from the 'non-deflecting' mode to the 'deflecting' mode immediately prior to the final reflection of ions at the second ion mirror 15. While both ion mirrors operate in the 'non-deflecting' mode ions undergo multiple passes between the ion mirrors.

As will be described in greater detail hereafter with reference to FIGS. 3 and 4, reflection of ions through said angles $\theta_i$ and $\theta_o$ may be accomplished electrostatically; that is, by generating an electrostatic deflecting field which is superimposed on the electrostatic reflecting field. Alternatively, such reflection could be accomplished by magnetic means; that is by generating a magnetic deflecting field superimposed on the electrostatic reflecting field.

Figure 2A:
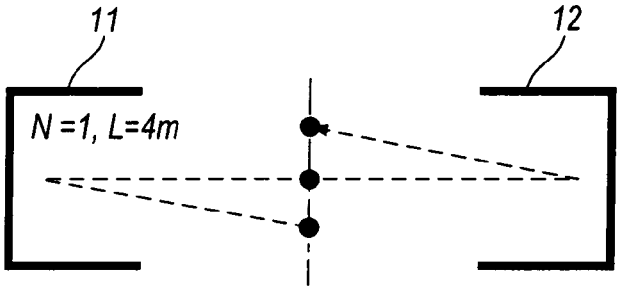
FIG. 2(*a*) shows the trajectory of ions on a single pass through the ToF mass spectrometer.
Figure 2B:
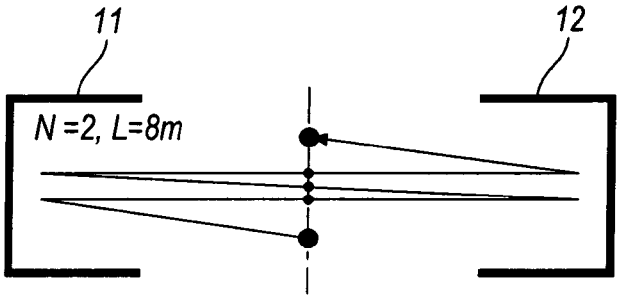
Figure 2C:
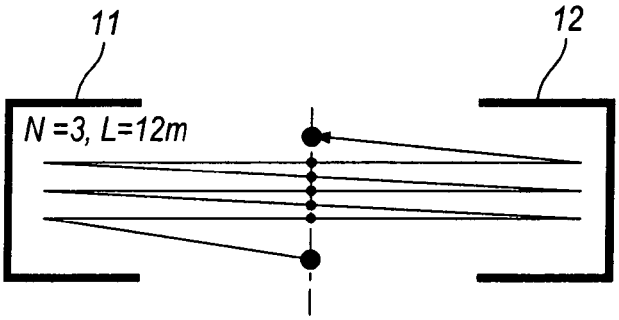

FIG. 2(*a*) is a schematic representation of the flight path of ions undergoing a single pass between the ion mirrors 11, 12 (i.e. N=1), whereas FIGS. 2(*b*) and 2(*c*) are schematic representations of the flight paths of ions undergoing two passes (i.e. N=2) and three passes (i.e. N=3) respectively between the ion mirrors. When N is greater than 1, the extended flight path gives on improved resolving power. The trajectories between the ion mirrors 11, 12 (after the initial reflection onto the longitudinal axis 13 and before the final reflection onto the output trajectory 15) are all substantially coaxial but are shown spaced apart in FIGS. 2(*b*) and 2(*c*) for clarity of illustration.

As described with reference to FIGS. 1 and 2, ions enter one of the ion mirrors (e.g. ion mirror 11) along the input trajectory 14 and leave a different ion mirror (e.g. ion mirror 12) along the output trajectory 15. Alternatively, though, the electrostatic reflecting fields of the two ion mirrors may be so configured that ions enter and leave the same ion mirror.

As shown in FIGS. 1 and 2 there is a third isochronous point $I_3$ located on the longitudinal axis 13 midway between the two ion mirrors 11, 12. In this embodiment, the three isochronous points $I_1$, $I_2$ and $I_3$ all lie in a common plane P, orthogonal to the longitudinal axis 13. All the isochronous points $I_1$, $I_2$ and $I_3$ lie within the bounds of the two ion mirrors 11, 12, and this results in an apparatus with much lower chromatic and spherical aberration coefficients when compared to the prior art. Also in this embodiment, the spectrometer can be operated with any number of passes N, without the need to adjust the voltages applied to the ion mirrors 11, 12.

It has been found that the isochronicity of ions within the ToF mass spectrometer is sensitive to the angles $\theta_i$ and $\theta_o$ by which the input trajectory 14 and the output trajectory 15 are respectively offset from the longitudinal axis 13, and that, preferably, $\theta_i$ and $\theta_o$ should not exceed a value given by:

$$\tan^{-1}\left[\frac{D_{min}}{L+l_i}\right] \tag{5}$$

Where L is the distance between the entrances to the ion mirrors, $l_i$, is the distance between the turning points within the ion mirrors and $D_{min}$ is the, or the minimum, outside transverse dimension of the ion mirrors. In the case of ion mirrors that are circular in cross-section $D_{min}$ is the outer diameter of the ion mirrors, in the case of ion mirrors that are oval in cross-section $D_{min}$ is the outer length of the minor axis and in the case of ion mirrors formed by parallel plate electrodes, $D_{min}$ is the distance between the plate electrodes.

The distance $l_i$ between the turning points can be determined by computer simulation. However, for practical purposes, the maximum angle $\theta_{max}$ for $\theta_i$ and $\theta_o$ can be approximated by the expression:

$$\vartheta_{max} = \tan^{-1}\left[\frac{D_{min}}{2L}\right] \tag{6}$$

It has been found that if $\theta_i$ and $\theta_o$ exceed this value significant deterioration of the isochronicity of ions can occur, resulting in reduced resolving power.

In a typical implementation of the invention, $\theta_{max}$ is 4° and $\theta_i$ and $\theta_o$ are in the range 0.5° to 1.5°, and are preferably 0.5°. In the embodiment shown in FIG. 1, the input and output trajectories intersect the longitudinal axis inside the ion mirrors, however this is not essential. As long as the trajectories intersect the axis at angles $\theta_i$ and $\theta_o$ the point of intersection can be anywhere along the longitudinal axis, inside or outside the ion mirrors.

When the isochronous points $I_1$ and $I_2$ are outside the bounds of the ion mirrors 11, 12 then angles $\theta_i$ and $\theta_o$ will be greater than $\theta_{max}$. This means that ions will enter/leave the ion mirrors 11, 12 away from the axis, where the chromatic and spherical aberrations are much higher, which will result in impaired isochronicity of the ions.

Figure 3:
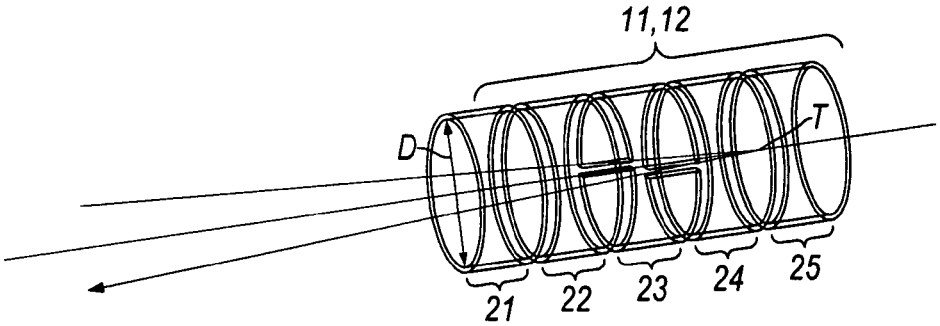
FIG. 3 shows the construction of an ion mirror used in the ToF mass spectrometer of FIG. 1.

FIG. 3 is a perspective view of a preferred embodiment of an axially symmetric ion mirror 11, 12. The ion mirror includes a stack of five concentric ring electrodes 21, 22, 23, 24 and 25. Each ring electrode of the stack is electrically insulated from the neighboring ring electrode or electrodes so that different DC voltage may be supplied to each electrode.

Typically, each ring is made from an electrically insulating material having a metallic coating deposited on its inside surface. The electrically insulating material should preferably have a low coefficient of thermal expansion, typically less than 1 ppm/° C. Suitable materials include quartz glass, although a glass ceramic Zerodur® is preferred because it has a very low coefficient of thermal expansion (<0.2 ppm/° C.) and can be accurately machined making it an ideal material for use as a substrate for the metallic coating.

Figure 4C:
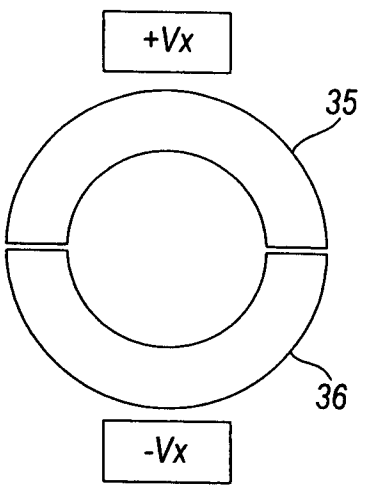
FIG. 4(*a*) is a cross-sectional view of one embodiment of the tilting electrode of the ion mirror.
Figure 4B:
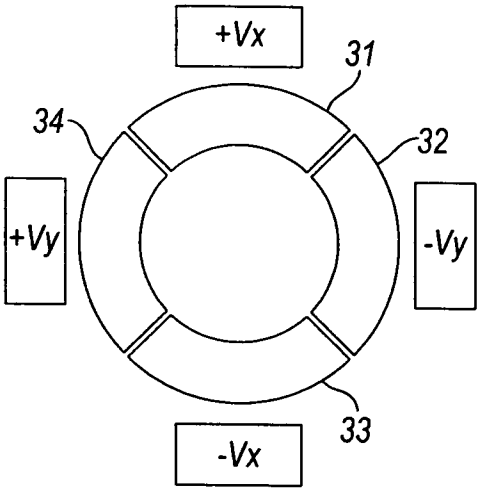
Figure 4A:
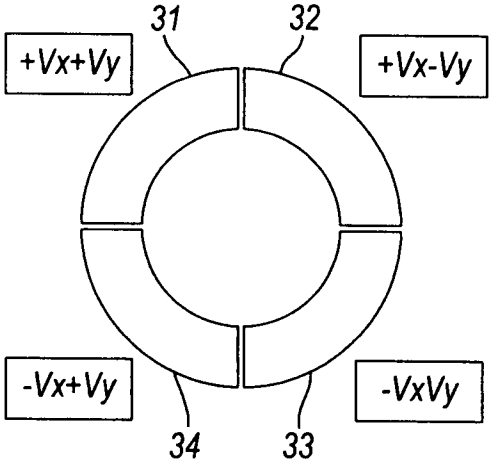

As shown in FIG. 3, one of the ring electrodes (in this example the central electrode 23) is designated as a 'tilting' electrode and has a split configuration comprising two semicircular portions 35, 36 shown in greater detail in FIG. 4(*c*). In alternative split-ring configurations, the ring electrode 23 is separated into quadrants 31 to 34 as shown in FIGS. 4(*a*) and 4(*b*).

DC dipole voltage supplied to the tilting electrode is effective to create an electrostatic deflecting field inside the ion mirror which is superimposed on the normal electrostatic reflecting field. FIGS. 4(*a*) to 4(*c*) show the respective polarities of the dipole voltage at each portion of the electrode.

The electrostatic deflecting field is effective to reflect ions away from the input trajectory 14 onto the longitudinal axis 13 and to reflect ions away from the longitudinal axis 13 onto the output trajectory 15, as described above with reference to FIG. 1 and FIG. 2(*a*).

The DC dipole voltage may be selectively supplied to the tilting electrode in order to control the reflection angle to enable ions to undergo multiple passes between the ion mirrors as described with reference to FIG. 1 and FIGS. 2(*b*) and 2(*c*). More specifically, when the DC dipole voltage is turned 'on' (so as to operate in the aforementioned 'deflecting' mode) the resulting electrostatic deflecting field causes ions entering ion mirror 11 on the input trajectory 14 to be reflected onto the longitudinal axis 13, and causes ions entering ion mirror 12 along the longitudinal axis 13 to be reflected onto the output trajectory 15. When the DC dipole voltage is turned 'off' (so as to operate in the 'non-deflecting' mode) the electrostatic deflecting field will not be generated and ions entering an ion mirror along the longitudinal axis 13 will be reflected back along the longitudinal axis 13 without being deflected, enabling ions to undergo multiple passes between the ion mirrors, as described earlier.

Figure 5B:
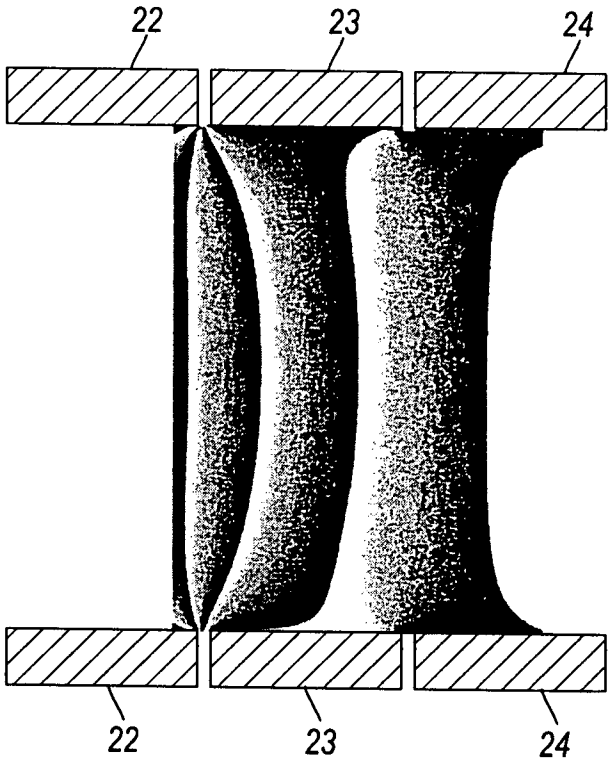
FIG. 5(*a*) is a representation of the equipotential lines of the electrostatic field created by a tilting electrode.
Figure 5A:
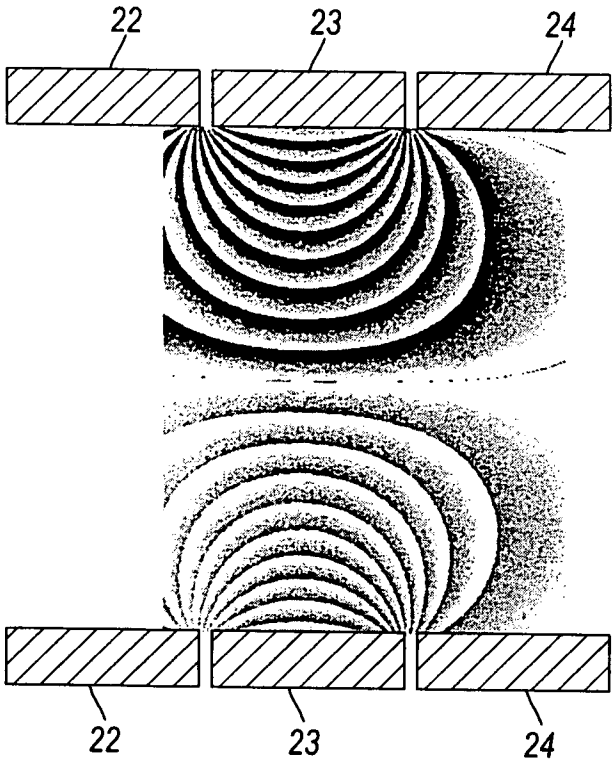

FIG. 5(*a*) shows the calculated equipotentials created by the tilting electrode 23.

Typically, the electrostatic deflecting field created by application of DC dipole voltage to the tilting electrode 23 is significantly weaker than the normal electrostatic reflecting field. FIG. 5(*b*) shows a superposition of the electrostatic reflecting field and the electrostatic deflecting field. In this illustration, the effect of the deflecting field has been artificially increased to show its influence (as ordinarily it is much weaker than the normal reflecting field).

DC dipole voltage supplied to the tilting electrode is principally used to create the electrostatic deflecting field as described hereinbefore, but can be used to correct for small misalignments of the components of the spectrometer.

As hereinbefore mentioned, in an alternative embodiment, the ion mirrors may be formed from two parallel insulating sheets on which a metallic coating is deposited to form appropriately shaped and sized electrodes. Zerodur® glass ceramic may be used for the insulating sheets. Ion mirrors formed in this way will also have a 'tilting' electrode provided with DC dipole voltage to operate in the manner described above.

Alternatively, the ion mirror may be produced by depositing a resistive coating onto an inner surface of an insulating tube or by using a tube made of resistive glass. The required electrostatic field can be generated by supplying voltages to each end of the tube. As each end of the tube has a uniform surface resistance, the voltage along the inner length of the tube will vary uniformly, thus creating a uniform field. Of course, by varying the resistance along the inner surface more complex electrostatic fields may be produced.

Figure 6:
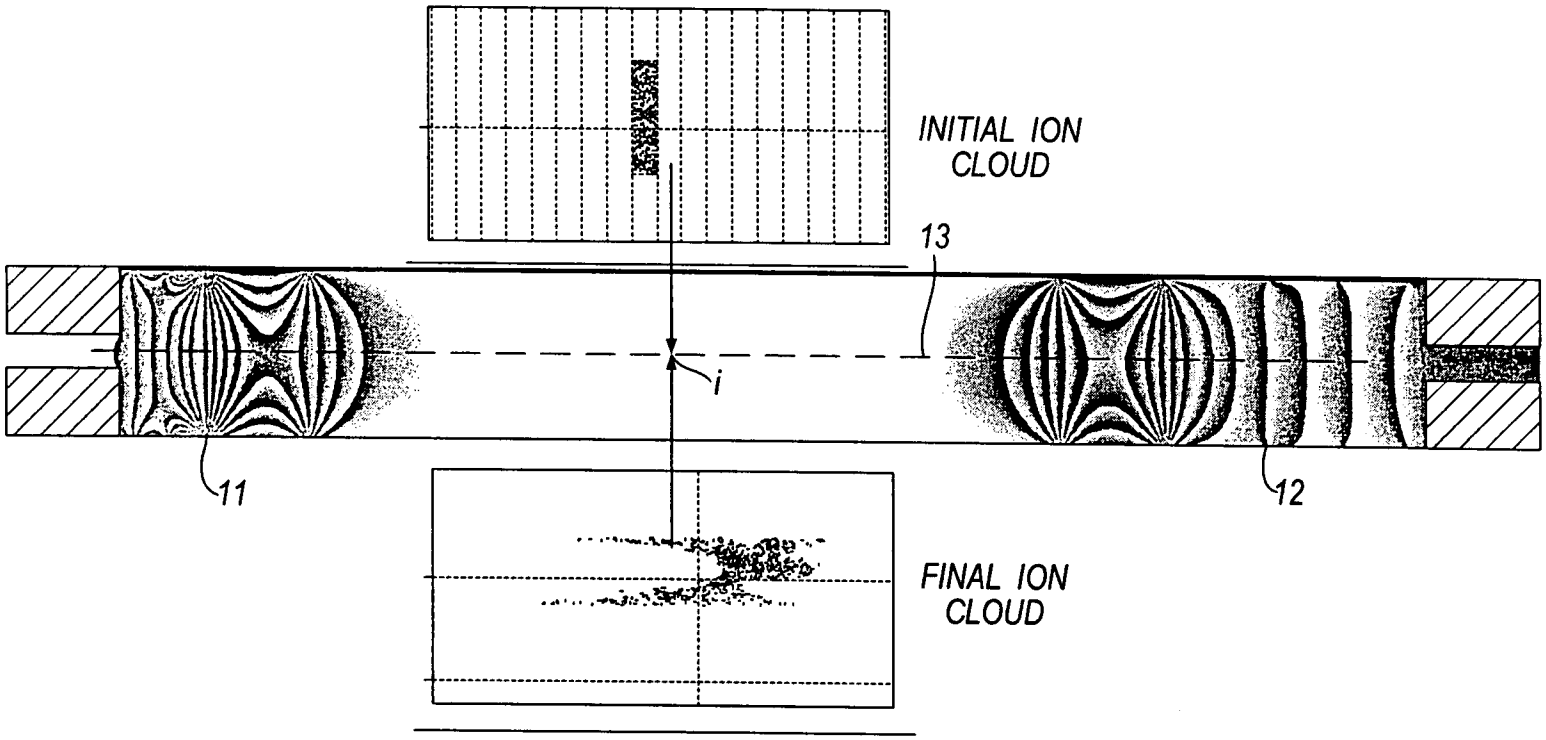
FIG. 6 is the result of a simulation showing the calculated potential and phase space of the initial ion cloud and the ion cloud after 128 passes through the ToF mass spectrometer.

FIG. 6 shows a simulation of the equipotentials within each ion mirror 11, 12 and the distribution in 'velocity-position' phase space of an initial ion cloud and the final ion cloud after 128 passes (N=128) between mirrors 11, 12.

In the simulation, the length (L) between the ion mirrors was 70 cm, and the ion cloud was initiated from, and terminated at an isochronous point i located at the centre of the longitudinal axis 13 between the ion mirrors 11, 12. The position of the isochronous point means that the voltages on the electrodes can be optimized such that there are very small geometric and chromatic aberrations.

As FIG. 6 shows, the initial ion cloud has a length of 0.05 mm at the central isochronous point, and after 128 passes, the final ion cloud has a length of 0.2 mm at the isochronous point. This is equivalent to a combined chromatic and spherical aberration coefficient of 37 ps/turn, which is very small compared to the overall time dispersion in the complete system, i.e. all contributions to equation 7 (shown below).

As the results of the simulation show, when the initial and final isochronous points lie within the bound of the ion mirrors (like the embodiment as shown in FIG. 1), the spectrometer can be operated with any number of passes, N, without the need to adjust the voltages on the mirrors 11, 12, between successive passes to compensate for impaired isochronicity The reduction in combined chromatic and spherical aberration coefficient as illustrated in FIG. 6 improves the overall resolution of the spectrometer, and also improves the rate at which the resolution increases as N increases. As stated previously, the specific m/z range obtained for a particular value of N is given by Equation (4). For example, when N=5 it is possible to obtain an m/z range of ~250 Da, within an upper mass limit of ~1000 Da.

The resolving power of a ToF mass spectrometer of the form shown in FIGS. 1 and 2 is given by the expression:

$$R_{Nturns} = 0.5\frac{(N \cdot T_1)}{\sqrt{\Delta T_{detector}^2 + \Delta T_{turn_around}^2 + \Delta T_{t_jitter}^2 + \Delta T_{ab_angle}^2 + (N \cdot \Delta T_{ab_co_axial})^2}} \quad (7)$$

Where N=Number of passes, $T_1$=flight time for a single pass, $\Delta T_{ab_angle}$ is the combined spherical and chromatic aberration coefficient when ions enter/leave an ion mirror at a small angle of inclination (when the ion mirrors are operating in 'deflecting' mode), and $\Delta T_{ab_co_axial}$ is the combined spherical and chromatic aberration coefficient when the reflection between the ion mirrors is co-axial (when the ion mirrors are operating in 'non-deflecting' mode).

Using the following parameters: L (length of analyser)=2 m; Initial ion energy=7 kev for an ion cloud composed of singly charged ions with mass of 1000 Da; then $T_1$=91 μs The remaining parameters are assumed to be: $\Delta T_{detector}$=1 ns; $\Delta T_{turn_around}$=1.1 ns; $\Delta T_{jitter}$=0.5 ns; $\Delta T_{ab_angle}$=0.44 ns/reflection; $\Delta T_{ab_co_axial}$=0.09 ns/lap.

The best instrument resolution will be obtained when:

$$N.\,\Delta T_{ab_coaxial} >> \Delta T_{detector}^2 + \Delta T_{turn_around}^2 + \Delta T_{jitter}^2 + \Delta T_{ab_angle}^2 \quad (8)$$

In this case, $$RN_{turns} = \frac{1}{2}\frac{T_1}{\Delta T_{ab_co_axial}} \quad (9)$$

Figure 7A:
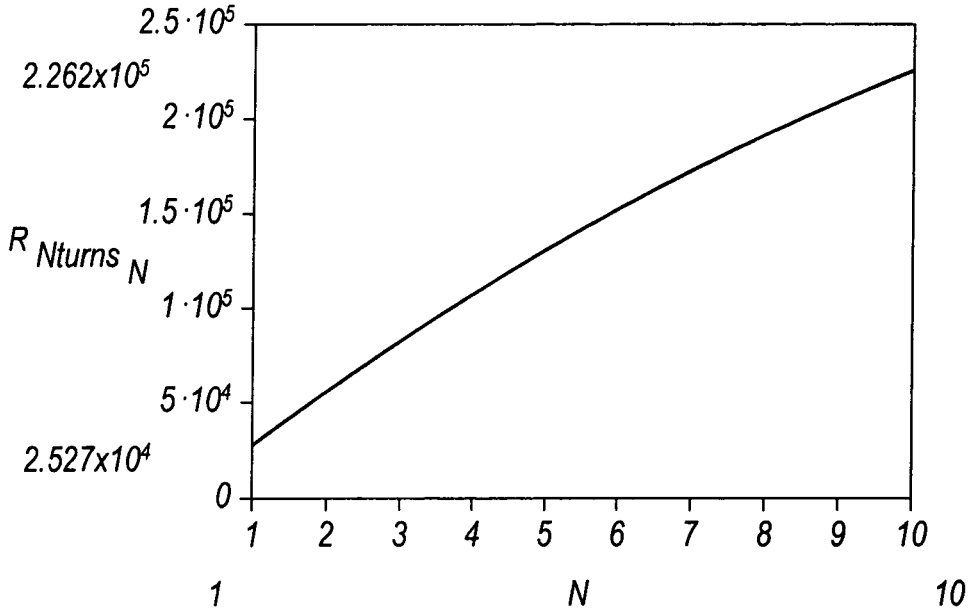
FIG. 7(*a*) is a plot of resolving power vs. number of turns, N, for a first parameter set.
Figure 7B:
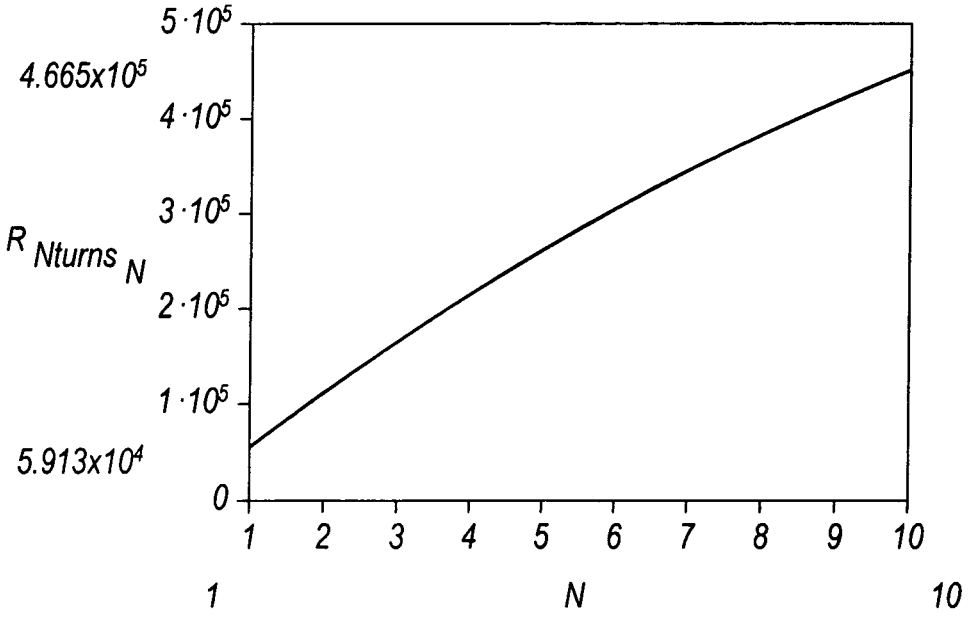

Using the parameter set listed above, the maximum instrument resolution achievable is 518 k. FIG. 7(*a*) illustrates the resolving power R, as a function of N for the above listed parameter set. As illustrated, when N=5, R is 108 k. This is close to the resolution that can be obtained from a conventional FTICR mass spectrometer.

FIG. 7(*b*) is a corresponding plot of resolution as a function of N for the following (improved) parameter set $\Delta T_{detector}$=0.5 ns; $\Delta T_{turn_around}$=0.5 ns; $\Delta T_{jitter}$=0.2 ns; $\Delta T_{ab_angle}$=0.44 ns; $\Delta T_{ab_co_axial}$=0.09 ns.

In this case, when N=5 the resolution is 276 k. As is clear from the FIGS. 7(*a*) and 7(*b*), as N increases, the resolution, R, increases faster for the second (improved) parameter set.

In both cases (FIGS. 7(*a*) and 7(*b*)) the ultimate resolution is obtained when $R_{Nturns}$ is given by equation (9) and will be 518 k.

For a particular mode of operation, it may be preferable to use a high performance ion source and/or detector. This will result in high resolution, R, after a relatively small number of passes N (because $\Delta T_{ab_angle}$ is relatively small), thereby maximising the m/z range to be analysed and the sensitivity of the analyser.

However, for applications where a wide m/z range or high sensitivity are not critical, then using a low performance ion source and/or detector for a higher number of passes, N, will provide the necessary high resolution.

Alternatively, or additionally, if the physical size available for the instrument is a limitation then the length of the spectrometer can be reduced proportionally, reducing the resolution.

Figure 8:
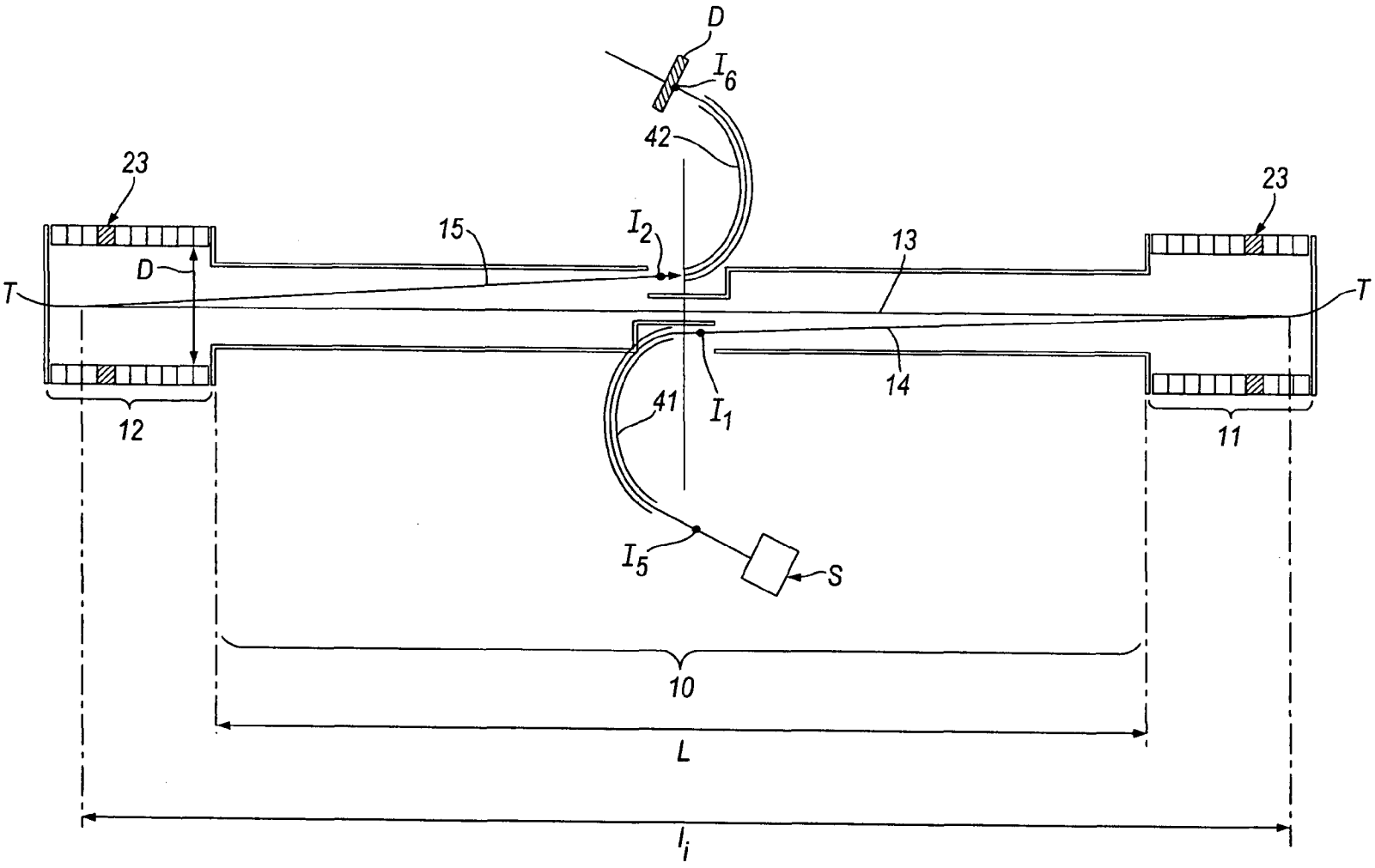
FIG. 8 shows a cross-sectional view of a ToF mass spectrometer including additional isochronous achromatic deflectors.

In the embodiment shown in FIG. 1 the ion source S is preferably a MALDI ion source and the detector D has a relatively small cross-section. In that embodiment, the source S and detector D can be positioned in close proximity to the longitudinal axis 13. However, this may not be the case for alternative types of ion source. In particular, if the ion source S is an Electro-Spray Ionisation (ESI) Source, with ionisation occurring at atmospheric pressure, the ion source S cannot be positioned close to the longitudinal axis 13. In this case, the ion source S includes additional ion delivery means to transport the ions to the ion mirror 11. Similarly, the ion detector D may include additional ion delivery means. In a preferred embodiment, shown in FIG. 8, these ion delivery means comprise isochronous achromatic inflectors.

Elements of the instrument that are the same as those shown in FIG. 1 have the same reference numerals. This instrument also includes isochronous achromatic inflectors 41 and 42. Ions pass out of ion source S to isochronous point $I_5$ and then into inflector 41. They ions pass out of inflector 41 and enter the ion mirror 11 along input trajectory 14, via the isochronous point $I_1$. Again, input trajectory 14 is offset from the longitudinal axis 13 by angle $\theta_i$, which is no greater than $\theta_{max}$.

A second achromatic inflector 42 transports ions leaving ion mirror 12 after the desired number of passes, N, between the ion mirrors, via isochronous point $I_2$ to the detector D. Like the FIG. 1 embodiment, the output trajectory 15 is offset from the longitudinal axis 13 by angle $\theta_o$, which is no greater than $\theta_{max}$.

Preferably, the isochronous inflectors 41, 42 are electrostatic sector lens. The inflector 41 ensures ions pass into ion mirror 11 via isochronous point $I_1$, and inflector 42 transports ions from ion mirror 12 to isochronous point $I_6$ at detector D. In this way, the inflectors 41, 42 deliver and remove ions to and from the ion mirrors 11, 12 without introducing significant aberrations.

The properties of inflectors 41, 42 are well established (Wollnik, Charged Particle Optics, Academic Press, 1987, Chapter 4). The electrostatic fields in the inflectors 41, 42 are characterized by two radii, $\rho_o$ and $R_o$. $\rho_o$ is the radius of the beam axis, and lies on the mid-equipotential between two deflector electrodes in the plane of deflection and $R_o$ is the radius of the mid-equipotential measured in a plane perpendicular to the plane of deflection. $\rho_o$ and the ratio $$\frac{Ro}{\rho o}$$

can be adjusted to provide a desired focussing condition. It is also possible to achieve the desired electrostatic field using a cylindrical sector ($R_o=\infty$) having flat plate electrodes. In this case, the flat plate electrodes are placed above and below the cylindrical sector, and appropriate voltages are applied.

If the isochronous inflectors 41, 42 are appropriately designed they will transport ions from isochronous points $I_5$ or $I_2$ to isochronous points $I_1$ or $I_6$ respectively, with negligible degradation in the width of the ion cloud, or the isochronous focus.

Figure 9:
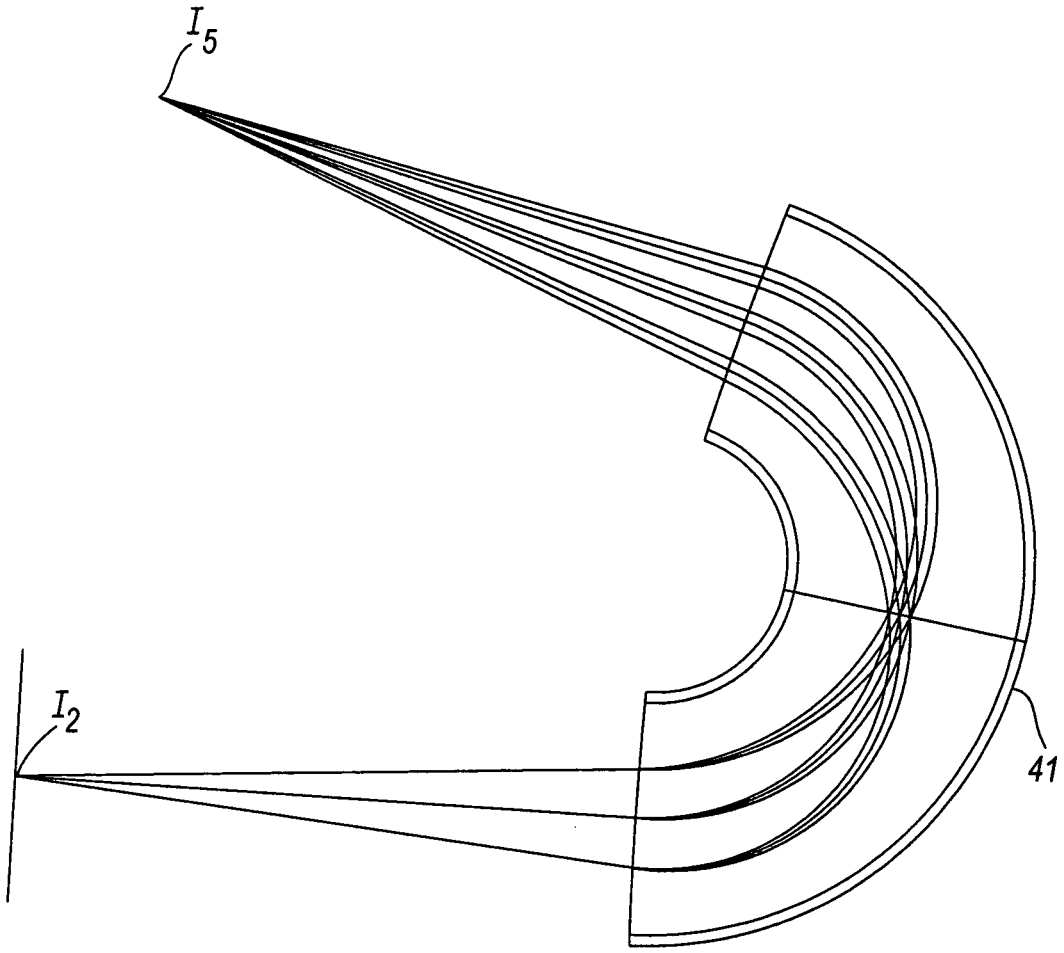
FIG. 9 shows a cross-sectional view of the isochronous achromatic deflectors of FIG. 8.

The inflectors 41, 42 also have lateral focussing properties in the direction of deflection, and the orthogonal direction. This lateral focussing is illustrated in FIG. 9.

Finally, in an alternative embodiment, inflectors 41, 42 may be combined with additional ion optical lens elements, so that a particular type of ion source is ion optically matched to the ion mirrors.

Figure 10:
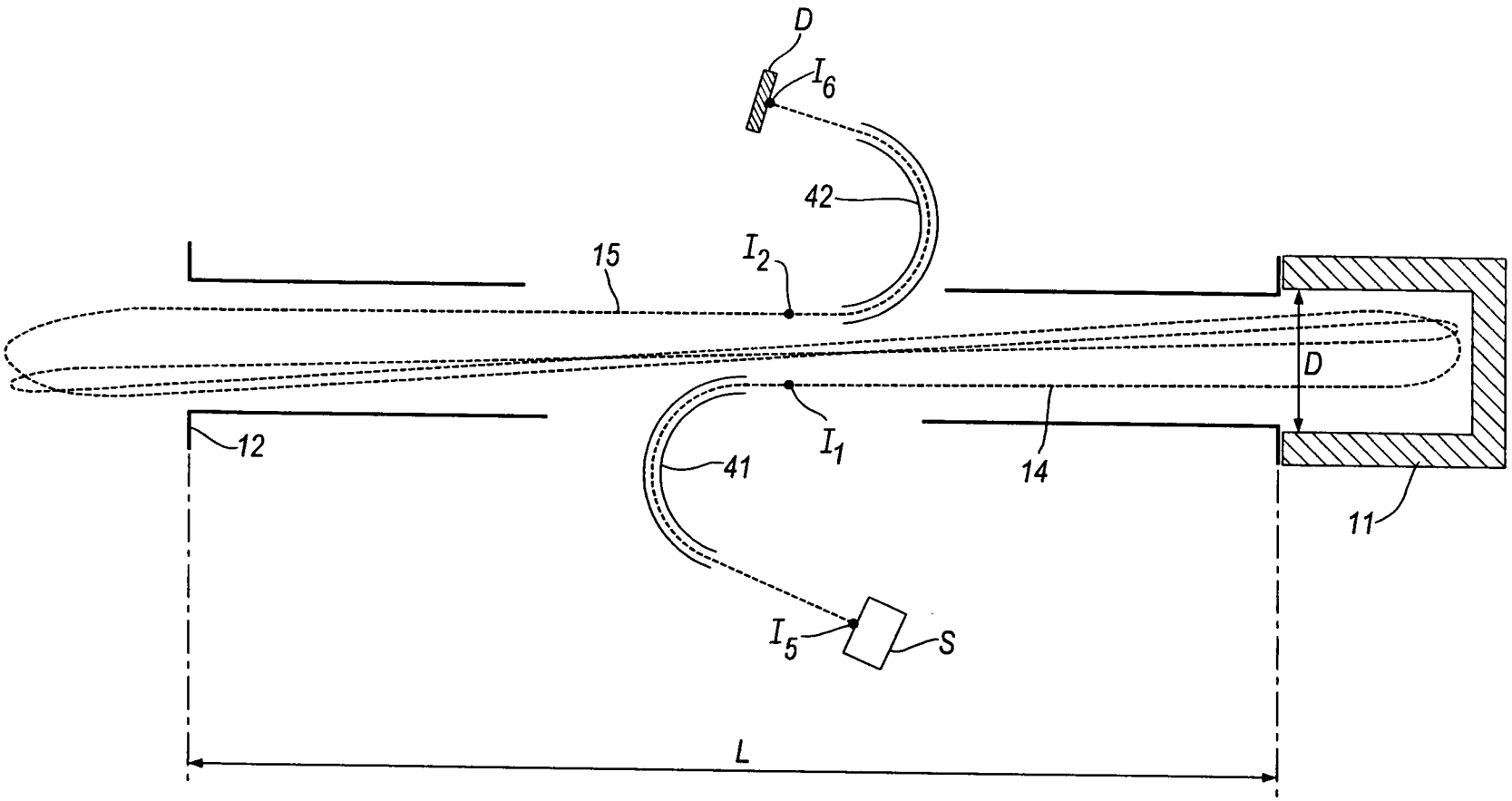
FIG. 10 shows the flight path of ions when the ToF mass spectrometer is in static (non-tilting) mode.

FIG. 10 shows a spectrometer according to an alternative embodiment of the invention. This embodiment of the invention uses purely electrostatic fields (no deflecting fields) in the ion mirrors which allows the flight path of ions in the spectrometer to be extended without reducing the m/z range of ions that are detected. The elements of the spectrometer shown in this figure are generally the same as elements described with respect to previous embodiments. It is possible that the ion mirrors 11, 12 have a tilting electrode 23 and this tilting electrode is simply not active in this embodiment. Although this figure shows ions being provided to ion mirror 11 via inflector 41, and being receiving at detector D via inflector 42, the ion source S and detector D do not have to be positioned in this way. Instead the ion source S and detector D may be positioned as shown in FIG. 1.

As illustrated in FIG. 10, ions enter ion mirror 11 along an input trajectory 14 that is parallel to and displaced laterally from the longitudinal axis 13. The voltages at ion mirrors 11, 12 are optimised so that ions follow the flight path shown in FIG. 10. As can be seen from this figure, the ions do not turn at the same position within the ion mirror at each reflection.

In the particular case as illustrated N=2, although any other value may be chosen for N. After the desired number of passes, ions leave mirror 12 along the output trajectory 15, which is parallel to and displaced from the longitudinal axis 13. Ions travelling along the output trajectory pass through isochronous point $I_2$, and are transported to detector D via inflector 41, for detection at isochronous point $I_6$. The input and output trajectories 14, 15 may be the same distance away from the longitudinal axis 13, or may be offset from longitudinal axis 13 by different distances. Also, either trajectory 14, 15 may be input to/or output from either ion mirror 11, 12. Furthermore, the input and output trajectory 14, 15 need not be into or out of different ion mirrors. They may be into and out of the same ion mirror. Also, the input and output trajectories 14, 15 may enter or/leave anywhere along the length of the section 10.

In the embodiment as illustrated, the ion mirrors 11, 12 do not operate in the 'deflecting' mode (as described earlier in this specification). However, in an alternative embodiment (not shown), after the ions have entered the ToF and completed the desired number of passes between mirrors 11, 12, one or both ion mirrors 11, 12 may be switched to operate in the 'deflecting' mode. This will cause ions to exit one of the ion mirrors along an output trajectory offset from the longitudinal axis 13 by angle $\theta_o$.

For any given N, the displacement of the input and output trajectories 14, 15 from the longitudinal axis 13 strongly influences the magnitude of aberrations in the ion cloud, and so to achieve the highest resolution it is preferable to make these displacements as small as possible. (Thereby minimising the combined spherical and chromatic aberrations). Nevertheless, if inflectors 41, 42 are used, then this displacement must be sufficient to allow the ion cloud to easily pass through the inflectors 41, 42.

The invention claimed is:

1. A co-axial time-of-flight mass spectrometer comprising:

first and second electrostatic ion mirrors, each ion mirror defining a longitudinal mirror axis and being coaxially arranged in opposed relationship on a common longitudinal mirror axis;

an ion source which supplies ions to one of said first and second coaxial ion mirrors without passing through either said first or second ion mirrors, said ions being provided along an input trajectory offset from the common longitudinal mirror axis, said ions being supplied via a first isochronous point lying within a volume extending between said first and second coaxial mirrors but radially offset from the common longitudinal mirror axis; and an ion detector which receives ions reflected from one of said first and second coaxial ion mirrors without passing through either said first or second ion mirror, said ions being provided along an output trajectory offset from the common longitudinal mirror axis, said ions being received at said ion detector at or via a second isochronous point lying within the volume extending between said first and second coaxial mirrors but radially offset from the common longitudinal mirror axis, after said received ions have performed at least one pass between said first and second ion mirrors, wherein said input trajectory and said output trajectory are offset from said longitudinal mirror axis by an angle less than or equal to $$\tan^{-1}\left[\frac{D_{min}}{2L}\right],$$

where $D_{min}$ is at least the minimum outside transverse dimension of said ion mirrors, and L is the distance between the entrances of said ion mirrors, and wherein at least one of said first and second ion mirrors comprises a plurality of electrodes, one of said electrodes being a tilting electrode having a split configuration which, when selectively supplied with a DC dipole voltage, generates an electrostatic deflecting field effective to deflect ions relative to said common longitudinal mirror axis.

2. A mass spectrometer as claimed in claim 1, wherein each said ion mirror is an axially-symmetric ion mirror.

3. A mass spectrometer as claimed in claim 1, wherein each said ion mirror is oval in cross section and $D_{min}$ is the length of the minor axis of said mirror.

4. A mass spectrometer as claimed in claim 1, wherein each said ion mirror comprises a pair of parallel plates and $D_{min}$ is the distance between the plates.

5. A mass spectrometer as claimed in claim 1, wherein the ions are supplied to the one of said first and second electrostatic ion mirrors via said first isochronous point and the ions are received from the other of said first and second ion mirrors via said second isochronous point.

6. A mass spectrometer as claimed in claim 1, wherein said first and second isochronous points lie in a common plane orthogonal to said common longitudinal axis.

7. A mass spectrometer as claimed in claim 1, having a third isochronous point positioned on said longitudinal axis between said first and second ion mirrors.

8. A mass spectrometer as claimed in claim 7, wherein said first, second and third isochronous points lie in a common plane orthogonal to said longitudinal axis.

9. A mass spectrometer as claimed in claim 1, wherein one of said first and second ion mirrors is arranged to reflect ions from said input trajectory onto said longitudinal axis and the other of said first and second ion mirrors is arranged to reflect ions from said longitudinal axis onto said output trajectory thereby enabling ions to undergo a single pass between the first and second ion mirrors.

10. A mass spectrometer as claimed in claim 1, wherein at least one of said first and second ion mirrors is arranged selectively to control a reflection angle whereby to enable ions to undergo multiple passes between the first and second ion mirrors.

11. A mass spectrometer as claimed in claim 10, wherein said first and second ion mirrors are arranged repeatedly to reflect ions along said longitudinal axis, one of said first and second ion mirrors being arranged selectively to reflect ions from said input trajectory onto said longitudinal axis and the other of said first and second ion mirrors being arranged selectively to reflect ions from said longitudinal axis onto said output trajectory.

12. A mass spectrometer as claimed in claim 1, wherein said electrodes are formed by depositing a metallic coating onto an insulating substrate.

13. A mass spectrometer as claimed in claim 1, wherein said electrodes are formed by depositing a controlled resistive layer onto an insulating substrate.

14. A mass spectrometer as claimed in claim 1, wherein said offset angle of said input trajectory or of said output trajectory is less than or equal to 4°.

15. A mass spectrometer as claimed in claim 14, wherein said offset angle is in the range 0.5° to 1.5°.

16. A mass spectrometer as claimed in claim 15, wherein said offset angle is ≤0.7°.

17. A mass spectrometer as claimed in claim 1, wherein said input trajectory or said output trajectory is offset from and parallel to said common longitudinal axis.

18. A mass spectrometer as claimed in claim 17, wherein ions undergo two or more passes between said first and second ion mirrors on non-coaxial trajectories before being reflected along said output trajectory to said ion detector.

19. A mass spectrometer as claimed in claim 17, wherein said first and second ion mirrors both comprise said plurality of electrodes.

20. A mass spectrometer as claimed in claim 19, wherein said electrodes include a metallic coating deposited onto an insulating substrate.

21. A mass spectrometer as claimed in claim 19, wherein said electrodes include a controlled resistive layer deposited onto an insulating substrate.

22. A mass spectrometer according to claim 1, wherein said ion source or said ion detector includes an isochronous achromatic inflector.

23. A mass spectrometer as claimed in claim 22, wherein the isochronous achromatic inflector is an electrostatic sector lens.

24. A mass spectrometer according to claim 1, wherein said electrodes are ring electrodes.

25. A mass spectrometer according to claim 1, wherein said tilting electrode has a split configuration comprising two semi-circular portions.

26. A mass spectrometer according to claim 1, wherein said tilting electrode has a split configuration comprising quadrants.

27. A mass spectrometer according to claim 1, wherein said electrodes comprise a pair of parallel plate electrodes.

* * * * *